United States Patent [19]

Hino

[11] Patent Number: 4,474,533

[45] Date of Patent: Oct. 2, 1984

[54] CONTROLLABLE PITCH PROPELLER ASSEMBLY

[75] Inventor: Michinobu Hino, Akashi, Japan

[73] Assignee: Kawasaki Jukogyo Kabushiki Kaisha, Kobe, Japan

[21] Appl. No.: 472,159

[22] Filed: Mar. 4, 1983

Related U.S. Application Data

[63] Continuation-in-part of Ser. No. 351,246, Feb. 22, 1982, abandoned.

[30] Foreign Application Priority Data

Feb. 23, 1981 [JP] Japan ..... 56-26015

[51] Int. Cl.[3] ..... B63H 3/08

[52] U.S. Cl. ..... 416/157 R; 416/167

[58] Field of Search ..... 416/146 A, 157, 49, 416/162, 167

[56] References Cited

U.S. PATENT DOCUMENTS

| | | | |
|---|---|---|---|
| 1,510,436 | 9/1924 | Englesson | 416/146 A X |
| 2,527,112 | 10/1950 | Willis et al. | 416/157 R X |
| 3,229,771 | 1/1966 | Hedberg | 416/49 X |
| 3,245,497 | 4/1966 | Yokoi | 416/146 A X |
| 3,247,908 | 4/1966 | Robook et al. | 416/146 A X |
| 3,501,251 | 3/1970 | Haglund et al. | 416/157 R |
| 3,792,937 | 2/1974 | Chilman | 416/157 R |
| 3,802,800 | 4/1974 | Merkx et al. | 416/157 R |
| 4,028,004 | 6/1977 | Wind | 416/49 X |
| 4,037,986 | 7/1976 | Chilman | 416/46 |
| 4,132,503 | 1/1979 | Kreft et al. | 416/167 |

FOREIGN PATENT DOCUMENTS

| | | | |
|---|---|---|---|
| 168030 | 12/1954 | Australia | 416/157 R |
| 666385 | 10/1938 | Fed. Rep. of Germany | 416/146 A |
| 947583 | 1/1949 | France | 416/146 A |
| 272376 | 3/1951 | Switzerland | 416/157 R |
| 675850 | 7/1952 | United Kingdom | 416/146 A |

OTHER PUBLICATIONS

Brochure: Kawasaki KT-N Side Thruster, Apr. 1980.

East German Magazine: Seewirtschaft, 6/1977, pp. 331-336.

*Primary Examiner*—Everette A. Powell, Jr.

*Attorney, Agent, or Firm*—Marshall, O'Toole, Gerstein, Murray & Bicknell

[57] ABSTRACT

The assembly includes a propeller shaft, a hollow hub closed at one end and secured at its other end to said shaft, a space being formed within said hub, said hub carrying blades which are rotatably driven by said shaft and hub and are changeable in pitch, a crosshead supported within said space for axially reciprocatable movement and coupled to said blades so as to change the pitch of said blades as said crosshead reciprocates, said crosshead having an end part adjacent said shaft and said end part forming a piston that is slidable on the inner surface of said hub, said piston defining on one side thereof a first chamber formed by said piston, said hub and said output end of said shaft, and defining a second chamber on its opposite side, formed by said piston and said hub, each of said chambers being adapted to be supplied individually with hydraulic fluid. The blades are rotatably connected to the hub, and the connection includes two spaced seals. The space between the seals is filled with pressurized oil which lubricates the connection and seals it against water.

6 Claims, 3 Drawing Figures

CONTROLLABLE PITCH PROPELLER ASSEMBLY

This is a continuation-in-part of application serial No. 351,246, filed Feb. 22, 1982, now abandoned.

The present invention relates to an assembly for a controllable pitch propeller, particulary of the type used as a side thruster for an ocean-going vessel, etc. Such side thrusters have been increasingly used in recent years on relatively large vessels. Normally they are mounted below the water line near the bow of the vessel, and by adjusting the pitch of the rotating propeller blades, the magnitude and direction of the side thrust may be controlled.

FIGS. 1 and 2 show a prior art controllable pitch propeller of this character. As shown in FIG. 1, a hub 4 of the prior art construction carries a plurality of propeller blades 1 (only one shown) and is fixedly connected to a propeller shaft 13 with the aft, or left-hand, end of the hub 4 covered by a cap 7. The dash-dot line around the blade 1 indicates the outline of the blade when viewed from the left. The pitch of the propeller blades 1 can be changed by axially displacing a crosshead 5 that is mounted inside the hub 4, using hydraulic oil. Inside the hollow propeller shaft 13 is provided, concentrically therewith, a hydraulic oil delivery pipe 9 which defines two oil paths, one on the inside and one on the outside of the pipe 9, either path being used for sending or returning the hydraulic oil. The inner cylindrical wall of the cap 7 forms a cylinder and the hydraulic oil is introduced into chambers either fore or aft of a piston 6. The piston 6 is secured to the crosshead 5 by a nut 8, and when the hydraulic oil is supplied to the chamber on the left of the piston 6, the piston is displaced to the right along with the delivery pipe 9 and the crosshead 5. The interior of the hydraulic oil delivery pipe 9 opens into the chamber to the left of the piston 6, while the oil path on the outside of the pipe 9 opens into the chamber to the right of the piston 6.

Each propeller blade 1 has a shaft-like inner or root section positioned through a blade-accommodating opening formed in the wall of the hub 4 and secured thereto by a disc 2 on the inside and bolts 11, etc., so that the blade 1 may be pivoted on its axis. A watertight seal 12 is provided for sealing the opening, and the interior of the hub 4 is filled with gravity oil introduced through a passage between the propeller shaft 13 and the sleeve 14.

The relationship between the crosshead 5 and the blades 1 is described in connection with FIG. 2, which is a sectional view on the line 2—2 of FIG. 1. An eccentric shaft or pin 15 projects from each disc 2 at a location which is off the axis of the blade. Each shaft 15 is positioned in a hole formed in a shoe 3 that is slidably set in a groove 5' in the crosshead 5. When the crosshead 5 is displaced fore or aft, the disc 2 is caused to rotate and thereby change the pitch of the blades 1 because of the eccentrically located shaft. The shoes 3 carrying the eccentric shafts 15 are free to slide in the grooves 5' provided in the crosshead in order to accommodate the eccentric movement of the eccentric shafts 15.

While the foregoing prior art construction works well, it is the purpose of the present invention to dispense with the cap 7 used in the above prior art hub construction and to simplify the construction and save on costs of material, assembly and machining as well as labor cost.

A controllable pitch propeller assembly according to this invention comprises a propeller shaft, a hub that is closed at one end and is secured at its other end to the output end of said shaft, a space being formed within said hub, said hub carrying blades that are rotated by said shaft and are changeable in pitch, a crosshead supported within said hub space and axially reciprocatable and coupled to said blades so as to change the pitch of said blades as said crosshead reciprocates, said crosshead having an end part that is adjacent to said shaft, said end part forming a piston which is slidable on the inner surface of said hub, said piston defining a first chamber in said space which is surrounded by said piston, the hub and its output end of said shaft, and a second chamber in said spaced surrounded by said piston and hub on the opposite side thereof, each of said chambers being adapted to be supplied individually with hydraulic oil.

The foregoing will be better understood when taken in conjunction with the accompanying figures of the drawings wherein.

Figure 1:
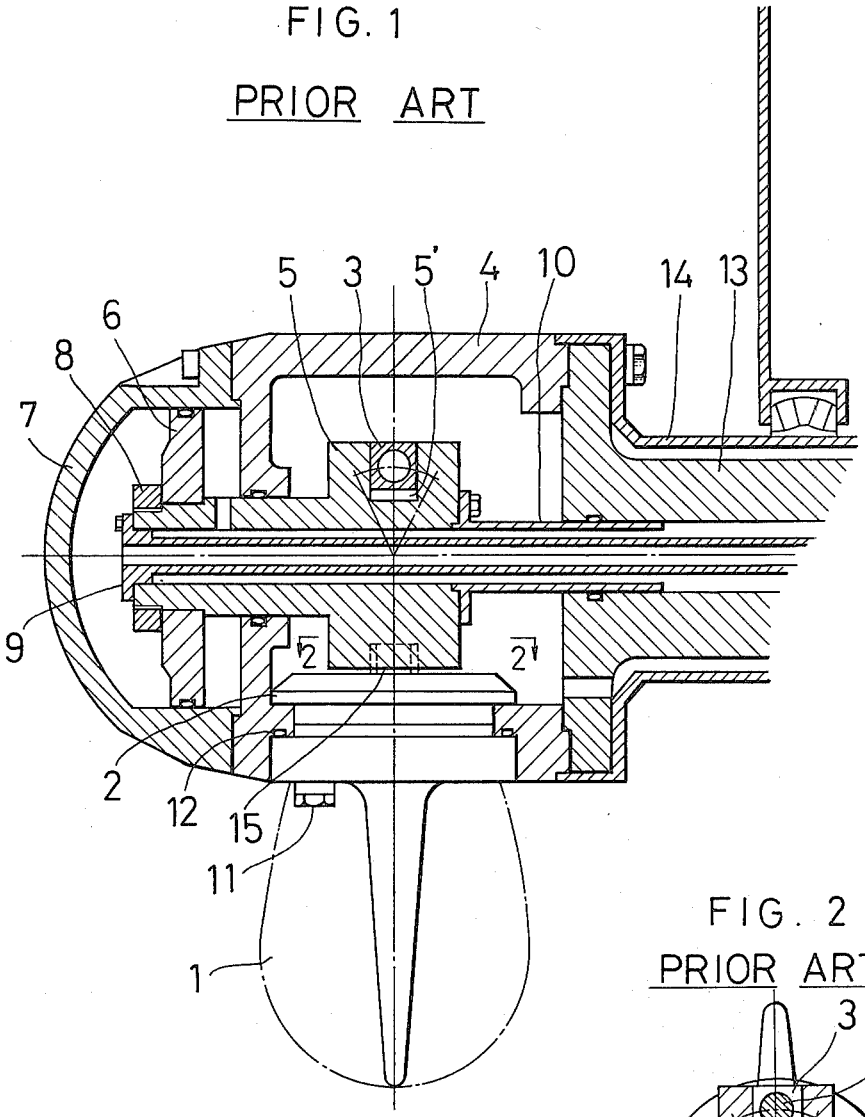
FIG. 1 PRIOR ART
FIG. 1 is a sectional view of a prior art propeller assembly.
Figure 2:
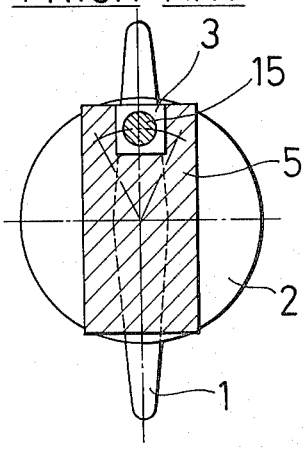
FIG. 2 PRIOR ART
FIG. 2 is a fragmentary sectional view taken on the line 2—2 of FIG. 1.
Figure 3:
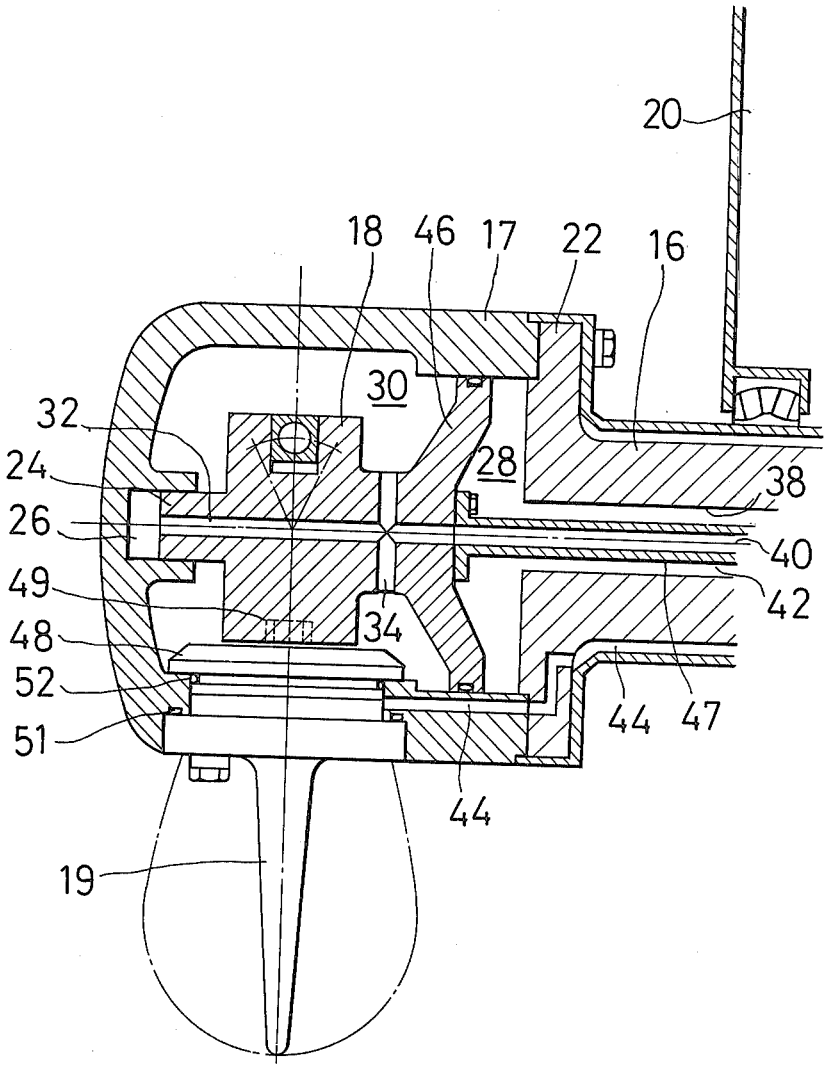
FIG. 3 is a sectional view of a propeller assembly in accordance with a preferred embodiment of the present invention.

A propeller shaft 16 (FIG. 3) extends from a mounting part or stay 20 and terminates in a flange 22 at its output end. A generally cylindrical one-piece hub 17 is closed at its aft end and open at the other end, the open end being bolted to the flange 22, and the hub 17 forming a space therewithin. The hub 17 encloses a crosshead 18 within the space, which is adapted to change the pitch of a plurality of blades 19 generally in the same manner as in the assembly shown in FIGS. 1 and 2. The crosshead 18 has an aft end projection 24 axially slidably supported within a central recess 26 formed in the hub 17.

The crosshead 18 has a piston 46 at its other end which is adjacent the flange 22. The piston 46 slidably engages the inner cylindrical surface of the hub 17 and defines a first cylinder chamber 28 surrounded by the piston 46, the cylindrical wall of the hub 17 and the flange 22, and a second cylinder chamber 30 surrounded by the piston 46 and hub 17 on the other side.

The crosshead 18 is formed with a central axially extending bore 32 therethough, the bore 32 having one end adjacent the flange 22 and the other end opening into the recess 26. A radial bore 34 interconnects the axial bore 32 with the chamber 30.

The propeller shaft 16 is formed with an axial bore 38 therethrough which opens in the chamber 28 formed in the hub 17. A hydraulic oil pipe 47 extends through the bore 38 and defines an inner oil passage 40 therewithin and an outer passage 42 therearound within the bore 38. The pipe 47 is connected with the piston end of the crosshead 18 by bolts to interconnect the inner passage 40 with the axial bore 32. The outer oil passage 42 communicates with the cylinder member 28, and the chambers 28 and 30 are filled with hydraulic oil.

Each of the blades 19 is rotatably mounted on the hub 17. The root of each blade extends through a circular opening in the hub, and a disc 48 on the inner end of each root engages the inner wall of the hub. Eccentric shafts or pins 49 connect the crosshead 18 with the discs 48 for rotating the shafts when the crosshead is moved longitudinally.

A passage 44 is formed in and through the shaft 16 and through the hub 17 to supply sealing oil to the disc 48 of the blades 19.

When the pitch of the blades 19 is to be changed, the chamber 30 and the recess 26, for example, are supplied with oil under pressure through the bores 40, 34 and 32, while the oil within the chamber 28 is withdrawn through the outer passage 42. This causes the crosshead 18 to be displaced toward the shaft 16, thereby rotating the discs 48 through the eccentric shafts 49 that are engaged with the crosshead 18, and changing the pitch of the blades 19.

It will be understood that the propeller pitch is changed in the opposite direction by supplying the chamber 28 with more oil and withdrawing the oil from the chambers 26 and 30.

To water seal the root of each blade 19, there is provided a seal 51 between the root and the hub wall. To ensure against leakage of hydraulic oil from the chamber 30, there is provided another seal 52 between the disc 48 of each blade and the hub wall and spaced from the seal 51. The seal 51 is spaced from the seal 52 outwardly radially of the hub. The space between these seals 51 and 52 is preferably filled with gravity oil introduced through the passage 44, to lubricate the seals and for a more elaborate seal by balancing the pressure of the gravity oil with the water pressure around the hub.

Thus, this invention reduces the number of parts as well as the manufacturing cost of the propeller assembly as compared with the prior art assembly. Further, the weight of the propeller is reduced and consequently the load on the drive shaft bearings is lightened. The distance between the stay 20 and the blades is greater and the hub is shorter than in the prior art and, hence, when applied to a ship's side thruster, the said distance can be increased without increasing the overall length of the hub. This arrangement reduces mutual interference between the propeller and the thruster body as well as vibration, thereby improving the propulsion efficiency. The discs 48 of the blades 19 extend into the chamber 30 of the hub 17, and the oil pressure in the chamber 30 may be relatively high or at a much lower value when the blades are being rotated to change the pitch. Despite the change in oil pressure, water leakage into the hub is prevented by the two spaced seals 51 and 52 and the pressurized oil between them.

What is claimed is:

1. An assembly for supporting and controlling the pitch of propeller blades that are adapted to be rotated by a propeller shaft, said assembly comprising a hub forming a space therewithin, said hub being formed by a wall and having a closed end and a shaft end which is adapted to be secured to said shaft, a plurality of blades mounted on said wall, a crosshead supported within said space for axially reciprocatable movement and coupled to said blades so as to change the pitch of said blades as said crosshead reciprocates, a piston formed on and extending radially outwardly from said crosshead, said piston being slidable on said hub, said crosshead and piston defining with said hub and said shaft a first chamber on one side thereof and on the other side thereof a second chamber, passage means for selectively supplying each of said chambers separately with hydraulic oil under pressure, the portion of the surface area of said crosshead and said piston which is in said first chamber being substantially entirely acted on by the oil pressure to move said crosshead axially in one direction, and the portion of said crosshead and said piston which is in said second chamber being substantially entirely acted on by the oil pressure to move said crosshead axially in the opposite direction, each of said blades including a root which rotatably connects with said wall at one of said chambers, first and second spaced seals between said root and said wall, and means for pressurizing said space between said seals.

2. An assembly according to claim 1, wherein said shaft is hollow, wherein said passage means comprises a hydraulic oil pipe adapted to extend through said hollow shaft, said pipe defining an inner oil passage therewithin and an outer oil passage therearound and within said shaft, said crosshead having a bore formed therethrough which opens to said second chamber, said pipe being connected to said crosshead so that said inner oil passage communicates with said bore, and said outer oil passage being connected to said second chamber.

3. An assembly according to claim 1, wherein said crosshead further includes a projection on a side which is displaced from said shaft end, said closed end of said hub forming a recess which receives said projection, said piston being adjacent said shaft end, said piston and said projection supporting said crosshead on said hub.

4. An assembly according to claim 3, wherein said crosshead includes a portion which is between said end portion and said projection and is adapted to be connected to said propeller blades.

5. A controllable pitch propeller, comprising a rotatable propeller shaft, a plurality of blades, a one-piece hub closed at one end thereof and secured at its other end to said shaft, a space formed within said hub, means supporting said plurality of blades on said hub for rotation with said shaft, said means further supporting said blades for pivotal movement thereof to thereby change the pitch of said blades, a crosshead supported within said hub for axially reciprocatable movement and coupled to said blades so as to change the pitch of said blades as said crosshead reciprocates, said crosshead having a first end part adjacent said shaft, said first end part forming a piston that is slidable on the inner side of said hub, said crosshead including said piston defining a first chamber on one side thereof formed by said piston, said hub and said shaft, and defining a second chamber on the opposite side thereof, formed by said piston and said hub, each of said chambers being adapted to be supplied individually with hydraulic oil, the portion of the surface area of said crosshead and said piston which is in said first chamber being substantially entirely acted on by the oil pressure to move said crosshead axially in one direction, and the portion of said crosshead and said piston which is in said second chamber being substantially entirely acted on by the oil pressure to move said crosshead axially in the opposite direction, said blade supporting means including a disc located within said second chamber and interconnected with said crosshead and the inner end of each of said blades for pivotally moving said blades, a first seal provided between said hub and said disc, a second seal provided between said hub and each of said blades and spaced from said first seal outwardly radially of said hub, the space between said seals being adapted to be filled with gravity oil.

6. Apparatus according to claim 5, wherein said other end part forms a projection, said hub forming a recess which receives said projection, and said projection sliding in said recess as said crosshead reciprocates.

* * * * *